US010577211B2

(12) United States Patent
Kuss

(10) Patent No.: US 10,577,211 B2
(45) Date of Patent: Mar. 3, 2020

(54) FLOATING MAT LAUNCH, RETRIEVAL, AND STORAGE APPARATUS

(71) Applicant: Kent E. Kuss, Lake Winnebago, MO (US)

(72) Inventor: Kent E. Kuss, Lake Winnebago, MO (US)

( * ) Notice: Subject to any disclaimer, the term of this patent is extended or adjusted under 35 U.S.C. 154(b) by 0 days.

(21) Appl. No.: 15/657,969

(22) Filed: Jul. 24, 2017

(65) Prior Publication Data

US 2018/0162671 A1 Jun. 14, 2018

Related U.S. Application Data

(60) Provisional application No. 62/366,383, filed on Jul. 25, 2016.

(51) Int. Cl.

| | |
|---|---|
| ***B65H 23/16*** | (2006.01) |
| ***B65H 23/198*** | (2006.01) |
| ***B65H 16/00*** | (2006.01) |
| ***B65H 18/08*** | (2006.01) |
| *E04H 4/10* | (2006.01) |

(52) U.S. Cl.

CPC ..... *B65H 23/16* (2013.01); *B65H 16/005* (2013.01); *B65H 18/085* (2013.01); *B65H 23/198* (2013.01); *B65H 2301/41429* (2013.01); *B65H 2301/41461* (2013.01); *B65H 2301/413226* (2013.01); *B65H 2402/31* (2013.01); *B65H 2404/1522* (2013.01); *B65H 2404/167* (2013.01); *B65H 2551/12* (2013.01); *B65H 2701/1922* (2013.01); *E04H 4/101* (2013.01)

(58) Field of Classification Search

CPC .... B65H 23/16; B65H 23/198; B65H 16/005; B65H 18/085; B65H 2701/1922

See application file for complete search history.

(56) References Cited

U.S. PATENT DOCUMENTS

| | | | | |
|---|---|---|---|---|
| 5,033,690 | A * | 7/1991 | McIver | B65H 54/585 242/532.6 |
| 7,243,875 | B2 * | 7/2007 | Holub | B65B 63/024 242/532.6 |
| 2017/0305583 | A1 * | 10/2017 | Nelson | B65H 16/005 |

* cited by examiner

*Primary Examiner* — Sang K Kim

(74) *Attorney, Agent, or Firm* — Cygnet IP Law, P.A.; Stephen W. Aycock, II

(57) ABSTRACT

An apparatus to launch, retrieve, and store a recreational floating mat is described. The apparatus can provide the advantages of helping to ease the potential difficulties associated with launching, retrieving and storing recreational floating mats from dock side, pool side or from a floating vessel such as a boat or floating dock.

8 Claims, 6 Drawing Sheets

FLOATING MAT LAUNCH, RETRIEVAL, AND STORAGE APPARATUS

RELATED APPLICATIONS

This application claims the benefit of U.S. Provisional Application No. 62/366,383, entitled "Floating Water Mat Storage Apparatus" and filed on Jul. 25, 2016, which is incorporated herein by reference in its entirety.

FIELD

This application relates generally to recreational water devices and, more particularly, to an apparatus to launch, retrieve and store a floating mat.

BACKGROUND

Recreational floating mats are popular products people use and enjoy in bodies of water such as pools, lakes, rivers and seas. Floating mats are typically made of a heavy duty flexible material that is buoyant, such as a foam material that may be coated with polyurethane or another water proof coating. Floating mats may range in size from a mat designed for an individual user to large mats designed to accommodate multiple people. Floating mats are often used in water adjacent to other structures such as docks, pool side decks, and boats.

The launch, retrieval and storage of floating mats can be difficult, especially with large mats designed for multiple people. The mats may be heavy, cumbersome and difficult to store. Due to these difficulties, some floating mats may simply be left fully or partially in the water, which can cause the floating mat to deteriorate from exposure to the elements, and become soiled or damaged by plants and/or animals found in or near the water. A need may exist for an apparatus to launch, retrieve and store floating mats.

Some implementations were conceived in light of the above-mentioned problems and limitations, among other things.

SUMMARY

Some implementations can include an apparatus to launch, retrieve and store a floating mat. The apparatus can include a center rolling assembly having a first end plate 124, a second end plate 126 and a plurality of longitudinal members 128 extending from the first end plate to the second end plate, and a winding mechanism coupled to a first end of a first shaft. The second end of the first shaft can be coupled to the first end plate of the center rolling assembly and the first shaft is supported by a first shaft support member. The winding mechanism can be operable to cause the center rolling assembly to rotate. The apparatus can also include a second shaft 130 coupled to the second end plate of the center rolling assembly, the second shaft supported by a second shaft support member that permits the second shaft to rotate, and a sliding tension roller assembly having a roller, the sliding tension roller assembly arranged to provide tension to urge the roller radially inward relative to the center rolling assembly. The apparatus can further include a mounting element having a first mounting element end 302 attached adjacent to the second shaft support member and having a second mounting element end 304 configured to attach to an external object. The mounting element can be constructed to support the apparatus.

The center rolling assembly can be arranged to engage the floating mat and roll the floating mat onto the center rolling assembly when the winding mechanism causes the center rolling assembly to rotate in a first direction, and to unroll the floating mat from the center rolling assembly when the winding mechanism causes the center rolling assembly to rotate in a second direction opposite the first direction.

The apparatus can also include a swivel disposed in the mounting element configured to permit the first mounting element end to rotationally swivel with respect to the second mounting element end. The apparatus can further include a rotational member disposed between the first mounting element end and the second mounting element end and configured to permit the center rolling assembly to be rotated between a first orientation and a second orientation.

The apparatus can also include a rotational member disposed between the first mounting element end and the swivel and configured to permit the center rolling assembly to be rotated between a first orientation and a second orientation. The apparatus can further include a first stop disposed on the mounting element and a second stop disposed on the mounting element. The first stop can be arranged to stop rotation of the center rolling assembly when the center rolling assembly reaches the first orientation, and the second stop is arranged to stop rotation of the center rolling assembly when the center rolling assembly reaches the second orientation.

The winding mechanism can include a round handle. The winding mechanism can include a motorized winding mechanism. The roller can include a first end and a second end. The first end can be adjacent the first end plate of the center rolling assembly and the second end can be adjacent the second end plate of the center rolling assembly. The sliding tension roller assembly can include a first spring 134 and a second spring 132, each having a first end coupled to the first end and second end of the roller, respectively, and the first spring and the second spring can each have a second end coupled to respective points adjacent the first shaft support member and the second spring, respectively, and the first spring and the second spring can each provide tension to urge the roller radially inward relative to the center rolling assembly.

The sliding tension roller assembly can be disposed and attached adjacent to one of the first shaft support member or the second shaft support member, and the sliding tension roller assembly can include a spring having a first end coupled to the roller and a second end coupled to one of the first shaft support member or the second shaft support member, and the spring can provide tension to urge the roller radially inward relative to the center rolling assembly.

DETAILED DESCRIPTION

Figure 1:
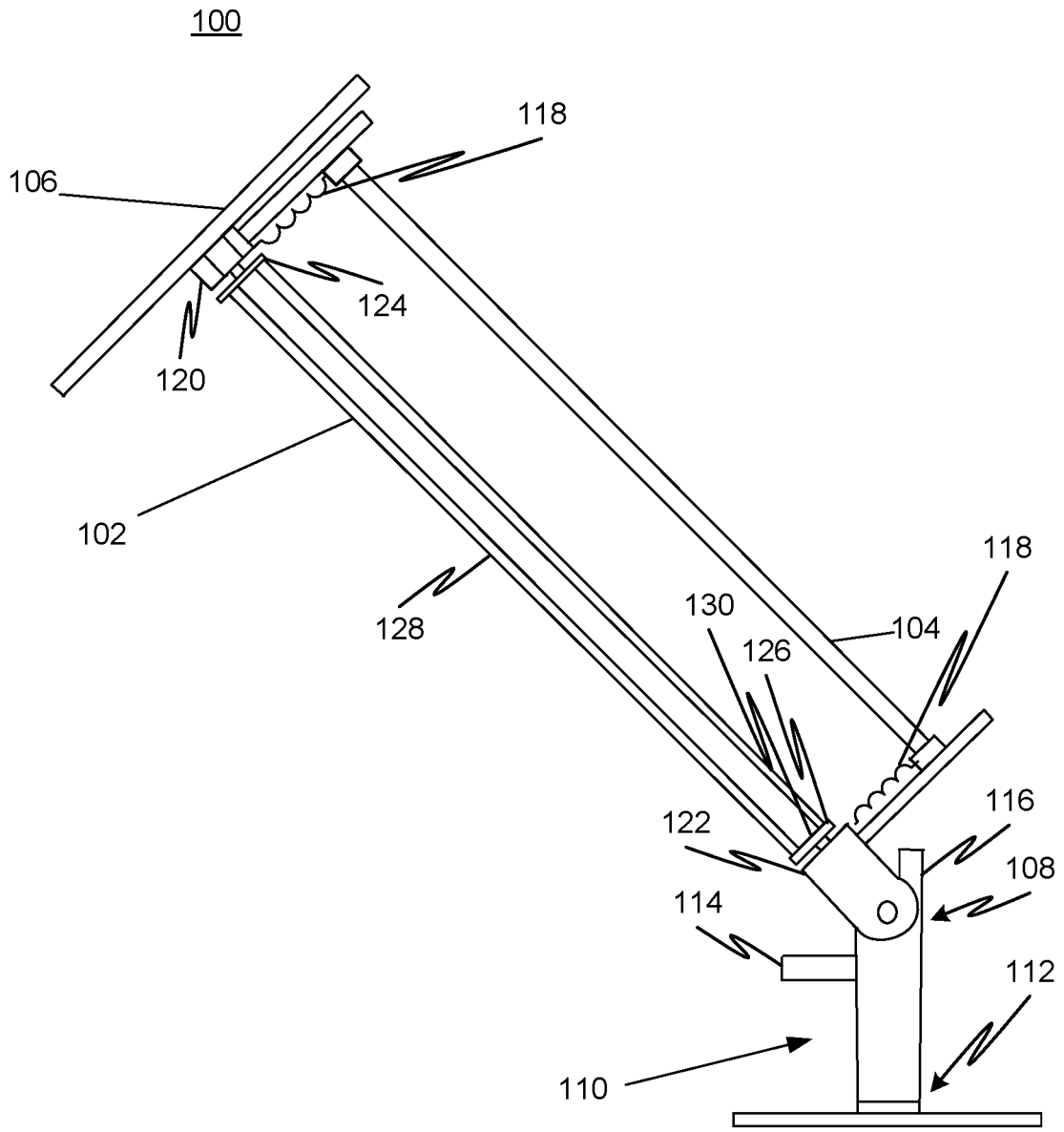
FIG. 1 is a diagram of an example apparatus for launching, retrieving and storing a floating mat in accordance with some implementations.
Figure 2:
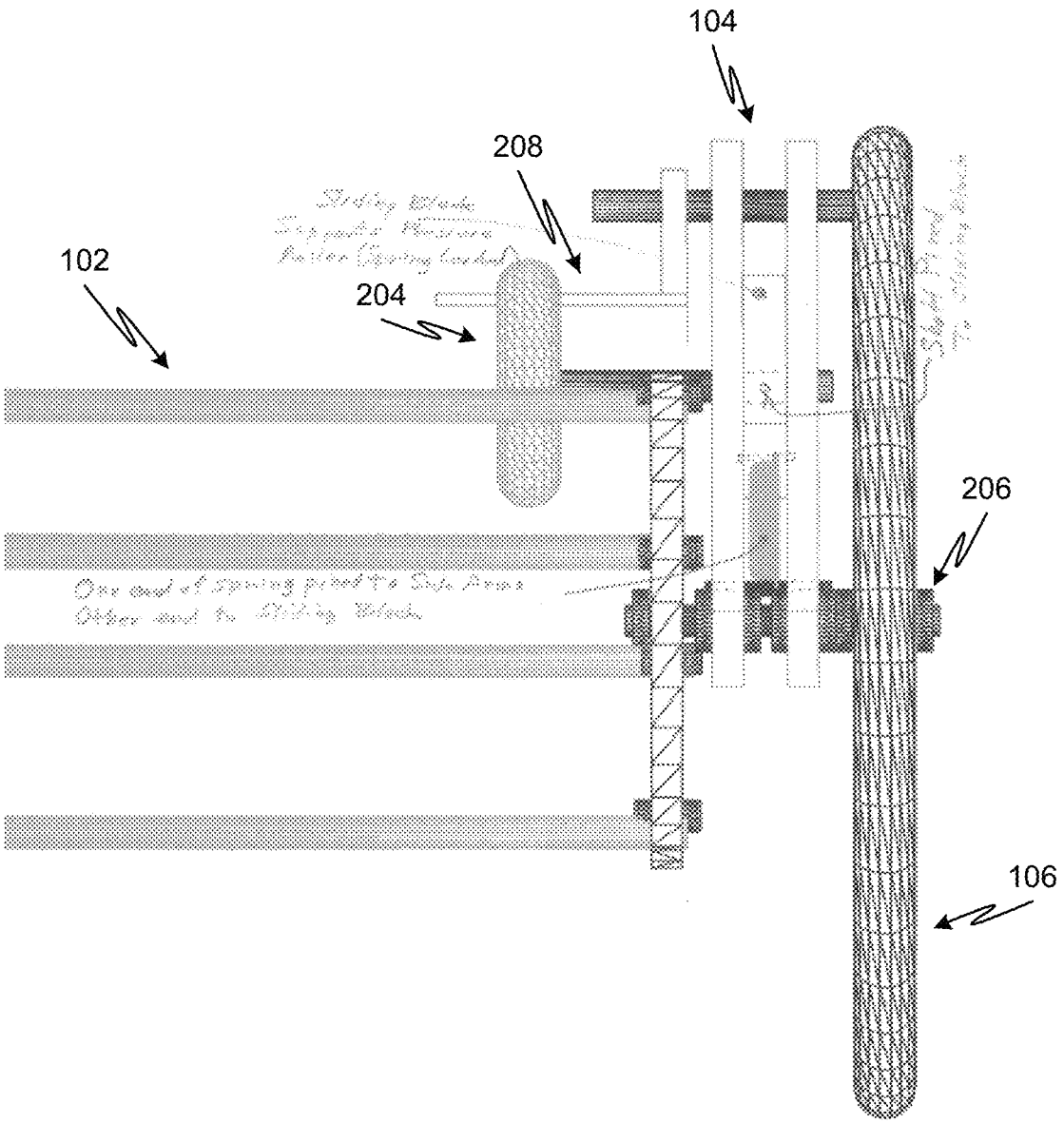
FIGS. 2-6 are diagrams showing details of a center rolling assembly and sliding tension roller assembly in accordance with some implementations.
Figure 3:
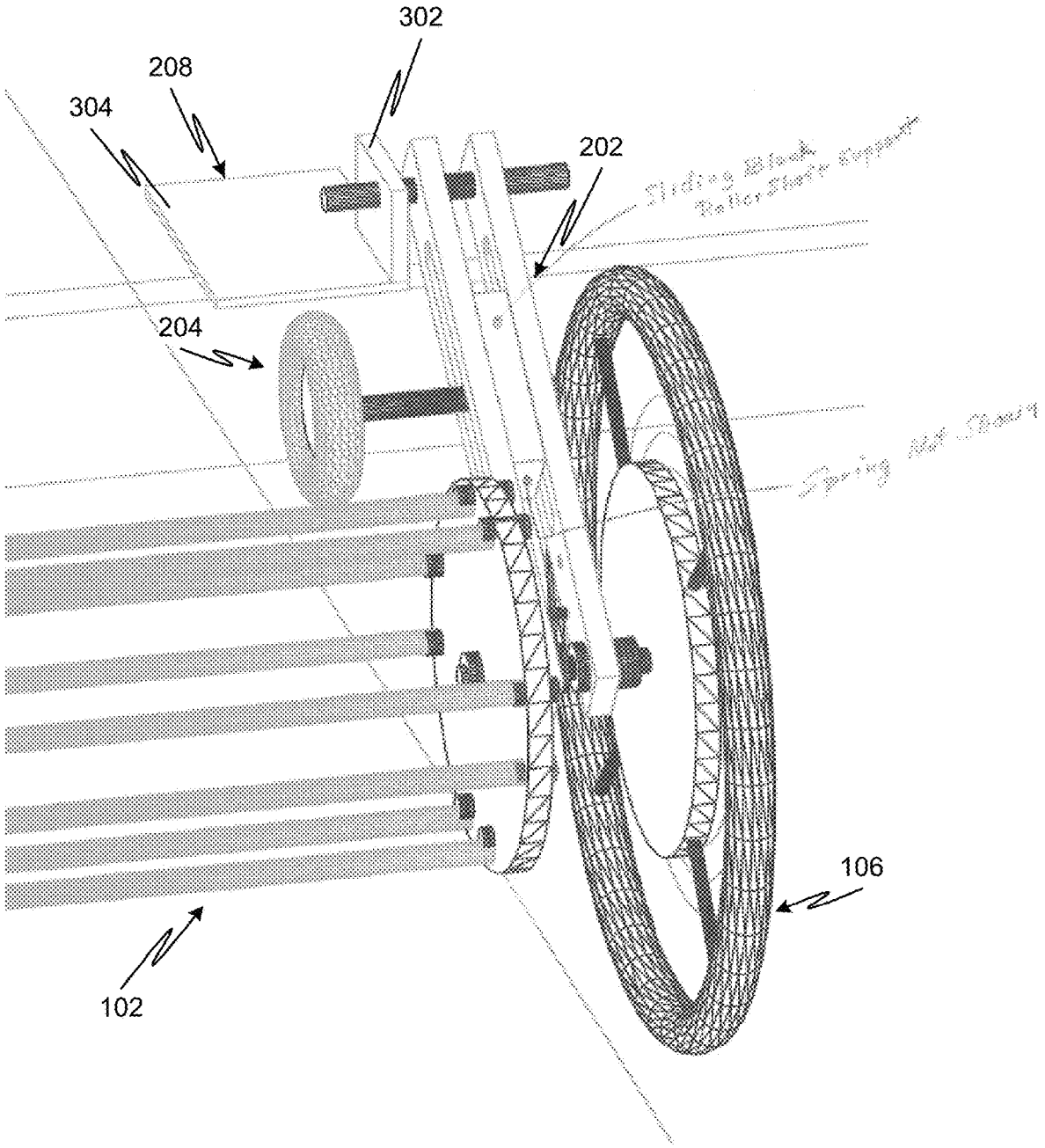
Figure 4:
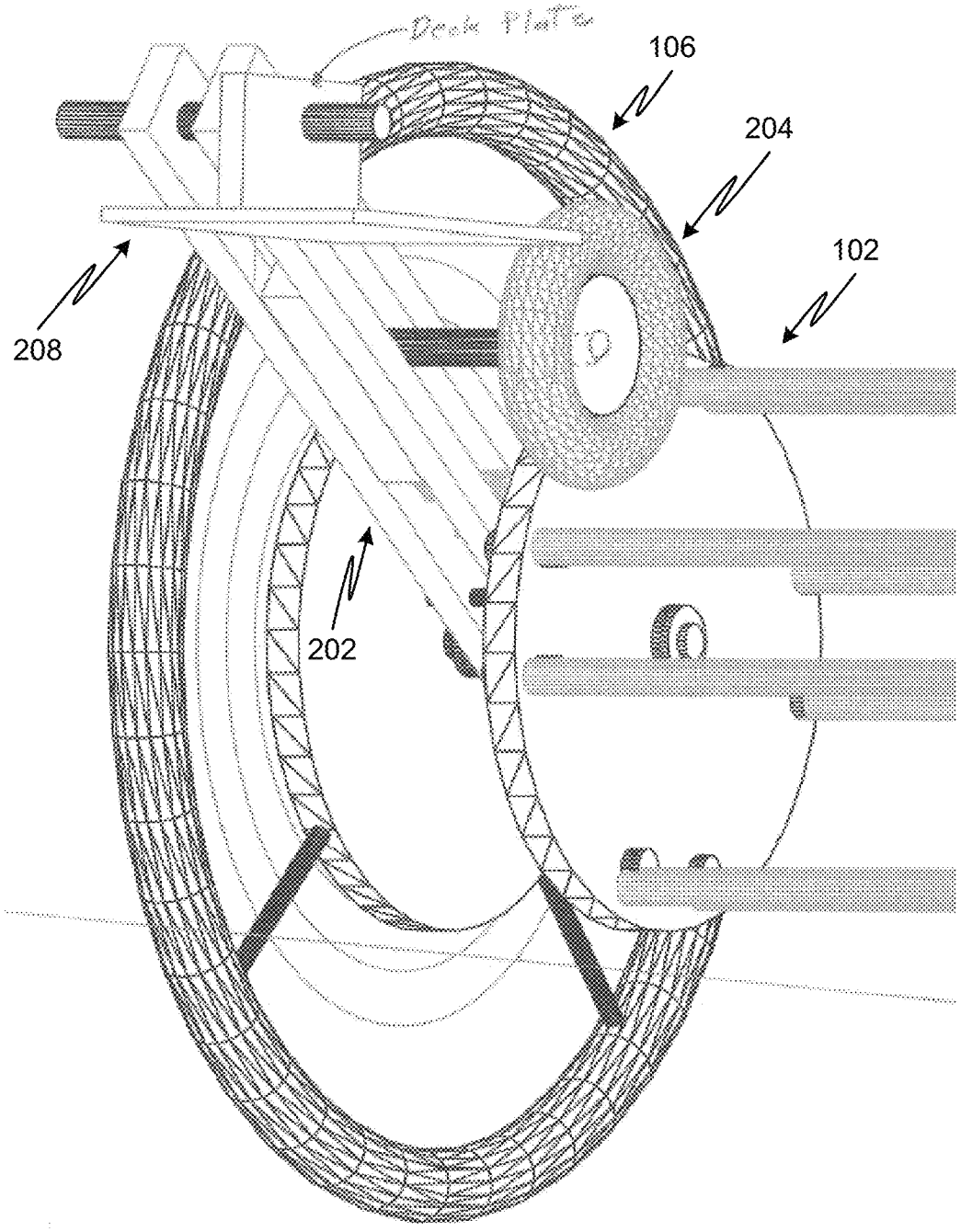
Figure 5:
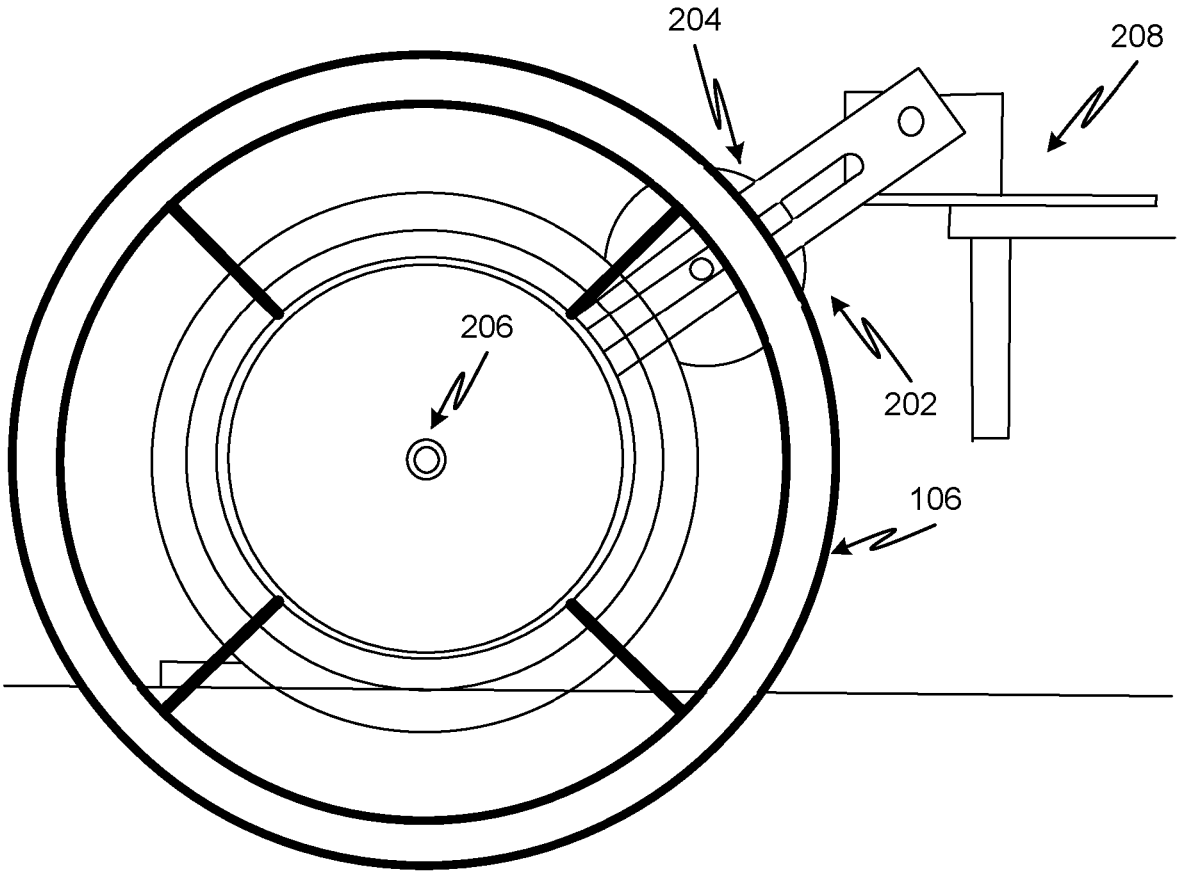
Figure 6:
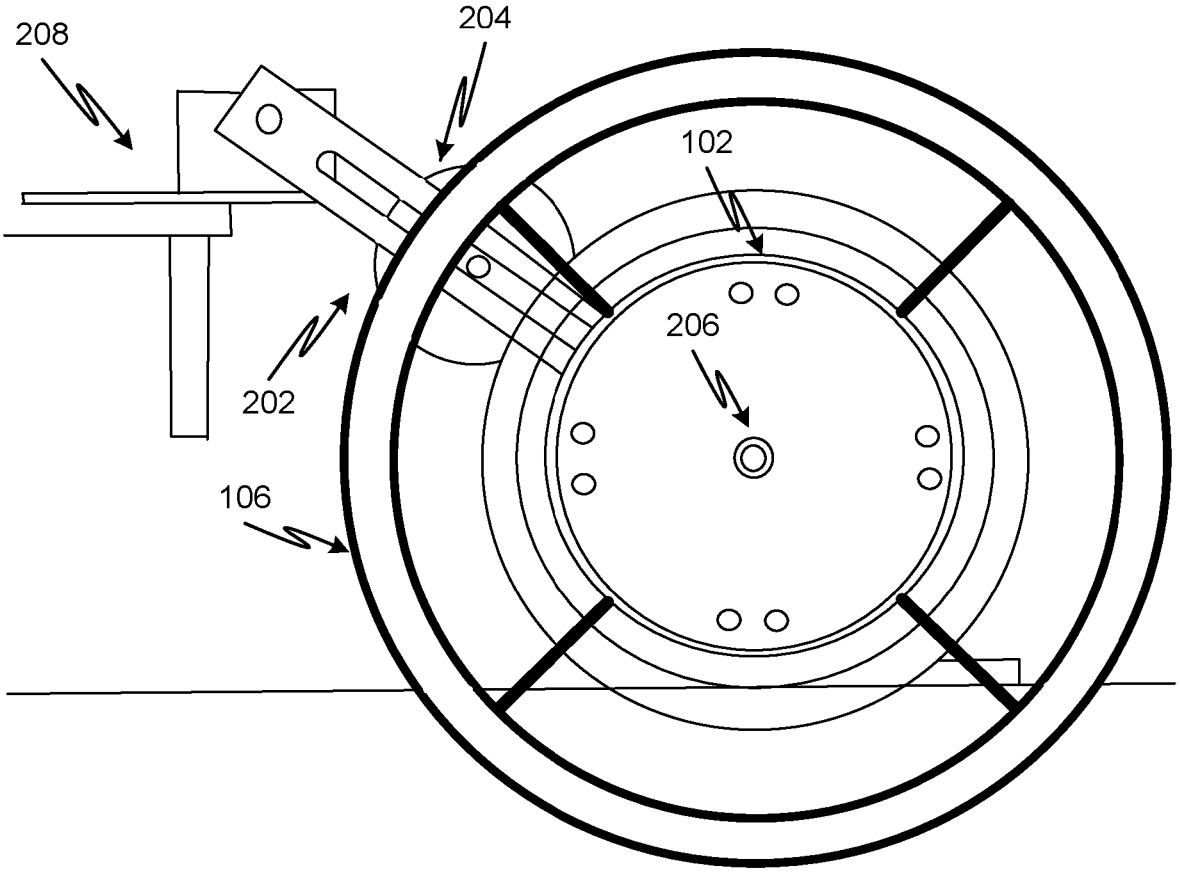

Some implementations include an apparatus to launch, retrieve, and store a recreational floating mat. The apparatus can provide the advantages of helping to ease the potential difficulties associated with launching, retrieving and storing recreational floating mats from dock side, pool side or from a floating vessel such as a boat or floating dock.

Some implementations of the apparatus can include a center rolling assembly having one or more longitudinal member disposed between respective ends of the center rolling assembly and arranged to retain a floating mat in place on the apparatus. The floating mat can be releasably attached to the center rolling assembly via ties or clamps that secure the floating mat to the center rolling assembly. The center rolling assembly is supported on each end by shafts and can be rotated via a handle or spin wheel that causes the center rolling assembly to rotate to launch the floating mat by unrolling the floating mat when rotated in a first direction, and to retrieve the floating mat by rolling the floating mat onto the center rolling assembly when rotated in a second direction opposite the first direction. The apparatus can include a handle or spin wheel on one or both ends of the apparatus. Each handle or spin wheel is mechanical coupled to a respective shaft and can cause the shaft to turn when the handle or spin wheel is turned, which in turn causes the center rolling assembly to turn. Some implementations can include a motorized element that causes the center rolling assembly to rotate. For example, the apparatus can include an electric motor coupled to the center rolling unit and center shaft that can be controlled via a wired or wireless controller to cause the center rolling unit to wind up or unwind a floating mat. The electric motor can be battery powered, solar powered, and/or powered from an electrical supply line (e.g., electrical supply from a dock electrical line, building electrical supply provided at a pool or pool deck, or from a boat electrical system). Some implementations can include a sliding tension roller that can help keep the mat rolled tightly onto the center roller assembly.

Some implementations can include a mounting element on one end of the apparatus, where the mounting element is configured to be mounted to an external object such as a dock, pool deck, boat, etc. The mounting element can include a swivel that permits the apparatus to swivel about a plane parallel to the surface onto which the mounting element is mounted (e.g., dock, pool deck, boat deck surface, etc.). The swivel can permit the apparatus to position the center roller assembly over a body of water for launch or retrieval.

Some implementations can include a rotational member disposed between the mounting element and the center rolling assembly, where the rotational element is constructed to permit the apparatus to transition from a first orientation in which the apparatus is in a generally parallel orientation with respect to a plane of the surface of a body of water surface (e.g., to facilitate launching or retrieving), to a second orientation in which the apparatus is in a generally angled orientation with respect to the plane of the surface of the body of water (e.g., rotated to an upright position for storage). By being able to transition between the parallel and angled (or upright) orientations, the apparatus permits ease of launch and retrieval and then helps to minimize the area taken up by a floating mat when not in use via the angled (or upright) storage orientation. Some implementations can include a locking mechanism on the rotational element to help prevent the rotational element from inadvertently transitioning from the second orientation (i.e., angled or upright) to the first orientation, or vice versa. Some implementations can include a counterweight or other mechanism (e.g., spring, hydraulic cylinder or air cylinder assist, similar to the device used to assist with vehicle trunk or hood opening and closing, etc.) to reduce the force needed to rotate the center rolling assembly from the first orientation to the second orientation. The mounting element can include a first stop and a second stop, where the first stop and the second stop are configured to position the center rolling assembly and prevent further movement in the first orientation and second orientation, respectively.

In an operational example, starting from a situation in which the floating mat is floating on a lake and the apparatus is attached to a dock in the lake, the sequence described below can be performed to retrieve, store and launch the floating mat. First, the apparatus can be swiveled to a position such that the center rolling assembly will be over the water when transitioned from the second orientation (i.e., angled or upright) to the first orientation. Next, the apparatus can be rotated from the second orientation to the first orientation such that the center rolling assembly is above the body of water and generally parallel to a plane of the surface of the body of water. The floating mat can be attached to the center rolling assembly (e.g., by inserting an edge of the bat into the center rolling assembly, by use of ties or straps, etc.). In some implementations, mechanism or members for attaching the mat to the center roller assembly can include straps, one or more bungee cords, a combination of straps, snaps or clamps, etc. In some implementations, the floating mat can be directly clamped to the center roller using one or more removable clamps.

The handle or spin wheel of the apparatus can be rotated to cause the center rolling assembly to wind up the floating mat onto the center rolling assembly. The mat can be kept tightly pressed against the center rolling assembly (or itself) as it is being wound up by a sliding tension roller assembly that is under tension causing it to exert pressure toward an axial center of the center rolling assembly.

Once the floating mat is wound onto the center rolling assembly, the center rolling assembly can be rotated from the first orientation to the second orientation and swiveled so as to be located back over the surface that the apparatus is attached to (e.g., dock, deck, boat, etc.). To launch the floating mat, the center rolling assembly can be swiveled back to a position in which the center rolling assembly will be over the water when transitioned to the first orientation. The center rolling assembly can then be rotated from the second (or upright) orientation to the first orientation. The handle or spin wheel can be rotated in a direction to cause the floating mat to be unwound from the center rolling assembly and launched on to the surface of the water. The center rolling assembly can then be moved out of the way by rotating to the second orientation and swiveling the center rolling assembly back over the surface the apparatus is attached to such as the dock, deck, or boat.

It will be appreciated that the floating mat can be stored in the first or second orientation, as desired by a user. Also, the center rolling assembly can be swiveled over the body of water or the structure the apparatus is attached to for storage. Launching and retrieving may typically be done with the center rolling assembly swiveled over the body of water and rotated to the first orientation, but other configurations for launching and retrieving are possible.

Further, it will be appreciated that the swiveling and rotational elements may facilitate ease of use and provide advantages, but are optional. Some implementations can include a fixed position center rolling assembly without a swivel or rotational member. Some implementations can include one of a swivel or rotational member, but not both. Some implementations can include both a swivel and a rotational member, as described above.

FIG. 1 is a diagram of an example apparatus 100 for launching, retrieving and storing a floating mat in accordance with some implementations. The apparatus 100 includes a center rolling assembly 102, a sliding tension roller assembly 104, a handle or spin wheel 106, a rotational member 108, a mounting element 110, a swivel 112, a first stop 114, a second stop 116, a load spring 118, a first shaft support 120, and a second shaft support 122. The center rolling assembly 102 is shown in FIG. 1 in transition from a first orientation (e.g., parallel to the surface of water) to a second orientation (e.g., upright for storage).

FIGS. 2-6 are diagrams showing details of a center rolling assembly 102 and sliding tension roller assembly 104 in accordance with some implementations. FIGS. 2-6 show a roller 204 that is a different implementation from the roller 104 shown in FIG. 1.

As shown in FIGS. 2-6, the handle/spin wheel 106 is coupled to the center rolling assembly 102 via shaft 206. The opposite end of the center rolling assembly is also mounted on a shaft (not shown in FIGS. 2-6). FIGS. 2-6 also show an implementation of a mounting element 208.

It is, therefore, apparent that there is provided, in accordance with the various embodiments disclosed herein, an apparatus to launch, retrieve and store a floating mat.

While the disclosed subject matter has been described in conjunction with a number of embodiments, it is evident that many alternatives, modifications and variations would be, or are, apparent to those of ordinary skill in the applicable arts. Accordingly, Applicant intends to embrace all such alternatives, modifications, equivalents and variations that are within the spirit and scope of the disclosed subject matter.

What is claimed is:

1. An apparatus to launch, retrieve and store a floating mat, the apparatus comprising:

a center rolling assembly having a first end plate, a second end plate and a plurality of longitudinal members extending from the first end plate to the second end plate;

a winding mechanism coupled to a first end of a first shaft, wherein a second end of the first shaft is coupled to the first end plate of the center rolling assembly and the first shaft is supported by a first shaft support member, wherein the winding mechanism is operable to cause the center rolling assembly to rotate;

a second shaft coupled to the second end plate of the center rolling assembly, the second shaft supported by a second shaft support member that permits the second shaft to rotate;

a sliding tension roller assembly having a roller, the sliding tension roller assembly arranged to provide tension to urge the roller radially inward relative to the center rolling assembly; and a mounting element having a first mounting element end attached adjacent to the second shaft support member and having a second mounting element end configured to attach to an external object, wherein the mounting element is constructed to support the apparatus, wherein the center rolling assembly is arranged to engage the floating mat and roll the floating mat onto the center rolling assembly when the winding mechanism causes the center rolling assembly to rotate in a first direction, and to unroll the floating mat from the center rolling assembly when the winding mechanism causes the center rolling assembly to rotate in a second direction opposite the first direction.

2. The apparatus of claim 1, further comprising a swivel disposed in the mounting element configured to permit the first mounting element end to rotationally swivel with respect to the second mounting element end.

3. The apparatus of claim 2, further comprising a rotational member disposed between the first mounting element end and the swivel and configured to permit the center rolling assembly to be rotated between a first orientation and a second orientation.

4. The apparatus of claim 1, further comprising a rotational member disposed between the first mounting element end and the second mounting element end and configured to permit the center rolling assembly to be rotated between a first orientation and a second orientation.

5. The apparatus of claim 1, further comprising a first stop disposed on the mounting element and a second stop disposed on the mounting element, wherein the first stop is arranged to stop rotation of the center rolling assembly when the center rolling assembly reaches the first orientation, and the second stop is arranged to stop rotation of the center rolling assembly when the center rolling assembly reaches the second orientation.

6. The apparatus of claim 1, wherein the winding mechanism includes a round handle.

7. The apparatus of claim 1, wherein the roller includes a first end and a second end, wherein the first end is adjacent the first end plate of the center rolling assembly and the second end is adjacent the second end plate of the center rolling assembly, and wherein the sliding tension roller assembly includes a first spring and a second spring, each having a first end coupled to the first end and second end of the roller, respectively, wherein the first spring and the second spring each have a second end coupled to respective points adjacent the first shaft support member and the second spring, respectively, and wherein the first spring and the second spring each provide tension to urge the roller radially inward relative to the center rolling assembly.

8. The apparatus of claim 1, wherein the sliding tension roller assembly is disposed and attached adjacent to one of the first shaft support member or the second shaft support member, wherein the sliding tension roller assembly includes a spring having a first end coupled to the roller and a second end coupled to one of the first shaft support member or the second shaft support member, and wherein the spring provides tension to urge the roller radially inward relative to the center rolling assembly.

* * * * *